US006450263B1

(12) United States Patent
Schwendemann

(10) Patent No.: US 6,450,263 B1
(45) Date of Patent: Sep. 17, 2002

(54) REMOTELY ACTUATED RUPTURE DISK

(75) Inventor: Kenneth L. Schwendemann, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/203,800

(22) Filed: Dec. 1, 1998

(51) Int. Cl.[7] ..... E21B 34/06; E21B 34/16

(52) U.S. Cl. ..... 166/373; 166/65.1; 166/66.6; 166/317; 166/386

(58) Field of Search ..... 166/376, 373, 166/386, 317, 65.1, 66.6

(56) References Cited

U.S. PATENT DOCUMENTS

| | | | | | |
|---|---|---|---|---|---|
| 3,737,845 | A | | 6/1973 | Maroney | |
| 3,906,435 | A | | 9/1975 | Lamel | |
| 4,609,005 | A | * | 9/1986 | Upchurch | 166/317 |
| 4,862,426 | A | | 8/1989 | Cassity | |
| 4,908,804 | A | | 3/1990 | Rorden | |
| 4,911,242 | A | * | 3/1990 | Hromas et al. | 166/317 |
| 4,986,350 | A | | 1/1991 | Czernichow | |
| 5,067,114 | A | | 11/1991 | Rorden | |
| 5,103,906 | A | * | 4/1992 | Schultz et al. | 166/264 |
| 5,146,983 | A | * | 9/1992 | Hromas et al. | 166/65.1 |
| 5,166,908 | A | | 11/1992 | Montgomery | |
| 5,272,680 | A | | 12/1993 | Stone | |
| 5,293,937 | A | | 3/1994 | Schultz | |
| 5,343,963 | A | | 9/1994 | Bouldin | |
| 5,363,094 | A | | 11/1994 | Staron | |
| 5,535,177 | A | | 7/1996 | Chin | |
| 5,546,359 | A | | 8/1996 | Aarseth | |
| 5,579,283 | A | | 11/1996 | Owens | |
| 5,611,401 | A | * | 3/1997 | Myers, Jr. et al. | 166/297 |
| 5,649,597 | A | * | 7/1997 | Ringgenberg | 166/373 |
| 5,696,733 | A | | 12/1997 | Zinn | |

* cited by examiner

*Primary Examiner*—Hoang Dang
(74) *Attorney, Agent, or Firm*—Paul I. Herman; David W. Carstens

(57) ABSTRACT

A remotely actuated rupture disk can be ruptured upon the receipt of a predetermined signal. The disk can be placed in a port, thereby separating different pressure regions. For example, if the disk is placed in a downhole tool assembly, the disk might be used to isolate a specific chamber from the annular well pressure. An actuation signal can be transmitted down the well's annulus and is received by a receiver coupled to the rupture disk. The received signal is conditioned to trigger a destructive material which then ruptures the disk, connecting the two pressure regions.

20 Claims, 5 Drawing Sheets

REMOTELY ACTUATED RUPTURE DISK

BACKGROUND OF THE INVENTION

1. Technical Field

The present invention relates generally to rupture disks used to actuate tools used in subterranean wells and, specifically relates to a rupture disk that can be ruptured upon receipt of a predetermined triggering signal from a remote source. The triggering signal can be an acoustic pressure pulse, an electromagnetic signal, a seismic signal, or from any other suitable source.

2. Description of the Related Art

Many downhole tools are dynamic. In other words, their movement or configuration can be altered once the tool has been lowered into the well as part of a tool string. Changing the configuration of a downhole tool is typically accomplished through the use of control lines that supply hydraulic pressure to the tool. The hydraulic pressure, when applied, can be used to push elements within the tool to specific locations or to perform specific functions.

A downhole tool has a specific function and typically must be actuated when it is adjacent to a specific formation strata. However, the use of control lines to actuate the tool implicates a number of additional design problems. For example, as the length of the control line increases, so does the hydraulic head experienced on the tool simply from the weight of the hydraulic fluid in the line. Further, the use of control lines increases the cost of the job and the risk of equipment failure.

Rupture disks offer another method of actuating downhole tools. A rupture disk is a plug used to block ports in the tool. Prior art rupture disks are designed to fail when subjected to a predetermined pressure. Once the disk fails, the port is exposed to pressurized fluid from outside the tool, which can flood compartments within the tool. The fluid pressure is then used to actuate the tool, instead of control line pressure. The pressure of the fluid is a function of the well depth. In other words, the increase in pressure is proportional to the depth of the well. The depth of the strata of interest is generally known. Therefore, the rupture disk chosen for a particular tool is sized to fail at the pressure associated with the depth of the specific strata.

FIGS. 1 to 5 illustrate the use of a rupture disk 12 with a prior art downhole valve 10. The valve 10 has a blocking member 16 that is generally spherical. The blocking member 16 has a central passage 18 that will allow the flow of fluid through the valve. The blocking member can also be rotated by linkage 20 to block the flow of fluid. The rupture disk is used to block port 14. The rupture disk is connected to the outer frame of the valve 10 across the port 14 with threads 12*b*. When the valve is lowered to a sufficient depth, the annulus pressure will rupture the disk, specifically, the pressure will rupture a centrally located rupture surface 12*a*, best shown in FIG. 5. Pressurized annulus fluid will then flood into chamber 22 and act against surface 24 of sliding member 26. As chamber 22 fills with fluid, the sliding member 26 will be forced downward within the valve 10. The sliding member 26 is coupled to the blocking member 16 by linkage 20 so that the downward motion of the sliding member 26 rotates the blocking member 16 into a blocking position. This tool configured for use with a rupture disk is susceptible to the same errors as plague all prior art rupture disks, an inability to precisely control the depth of actuation.

A need exists for a system of controlling the precise depth at which a rupture disk ruptures. Such a system would allow a tool to be placed at a correct depth before actuation. Further, such a system would include both an improved method for controlling the rupture event as well as an improved rupture disk apparatus.

SUMMARY OF THE INVENTION

The present invention provides both an improved method of actuating a downhole tool with a rupture disk as well as an improved rupture disk apparatus. The improved rupture disk includes a casing with a central flow passage and a rupture portion across the flow passage. The rupture disk also has a destructive material nested adjacent to the rupture portion. The destructive material can be either an explosive or a corrosive chemical. A rupture event can be initiated by the transmission of an acoustic signal down the fluid column in the well's annulus. The transmission could also be transmitted down the fluid column within the tool string. The signal is received by a receiver that generates a triggering signal that detonates the explosive destroying the rupture element. If a corrosive is released instead, it may simply weaken the rupture portion enough that the annulus pressure will burst the rupture portion.

The receiver can be a simple piezoelectric crystal with a range of vibrational frequencies. When a suitable vibrational acoustic signal is received by the crystal, it will produce a current which can be used to trigger the rupture event. This embodiment likewise would allow for the sequential firing of multiple ruptured disks. In one embodiment, several crystals can be coupled to separate rupture disks, wherein each crystal has a different resonant frequency. This allows separate addressing of various rupture disks and allow for the sequential firing of multiple rupture disks. Alternatively, the receiver can be a battery powered acoustic receiver coupled to a microprocessor. In this embodiment the microprocessor can be programmed to recognize many different acoustical signals and address any of the multiple number of ruptured disks with triggering signals. The method and apparatus is an improvement over the prior art in that the use of an acoustic signal to initiate the rupture event enables the user to ensure that the downhole tool has been properly located before actuation.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
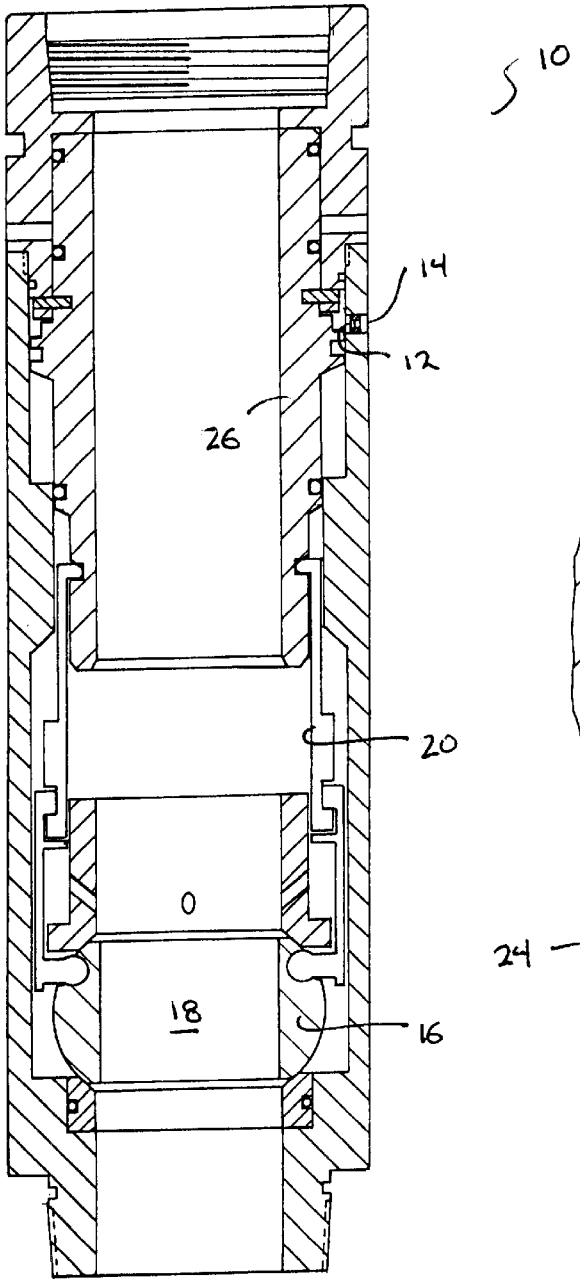
FIGS. 1 to 4 illustrate the use of a rupture disk to control the motion of a downhole valve.
Figure 2:
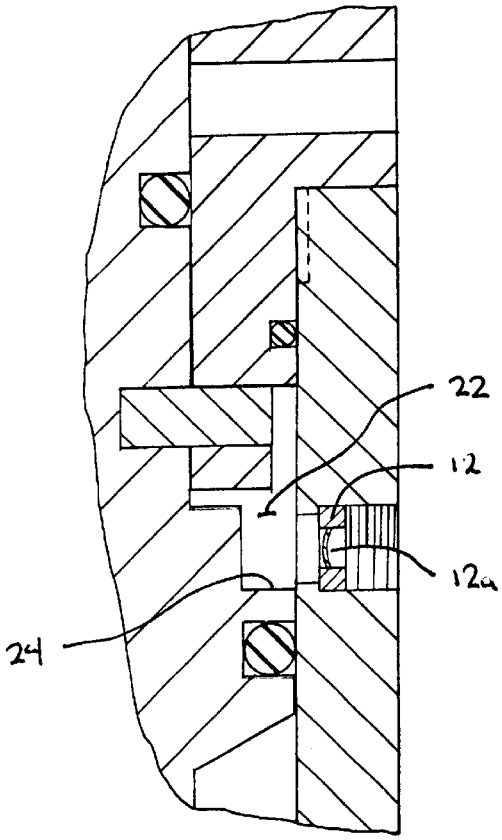
Figure 3:
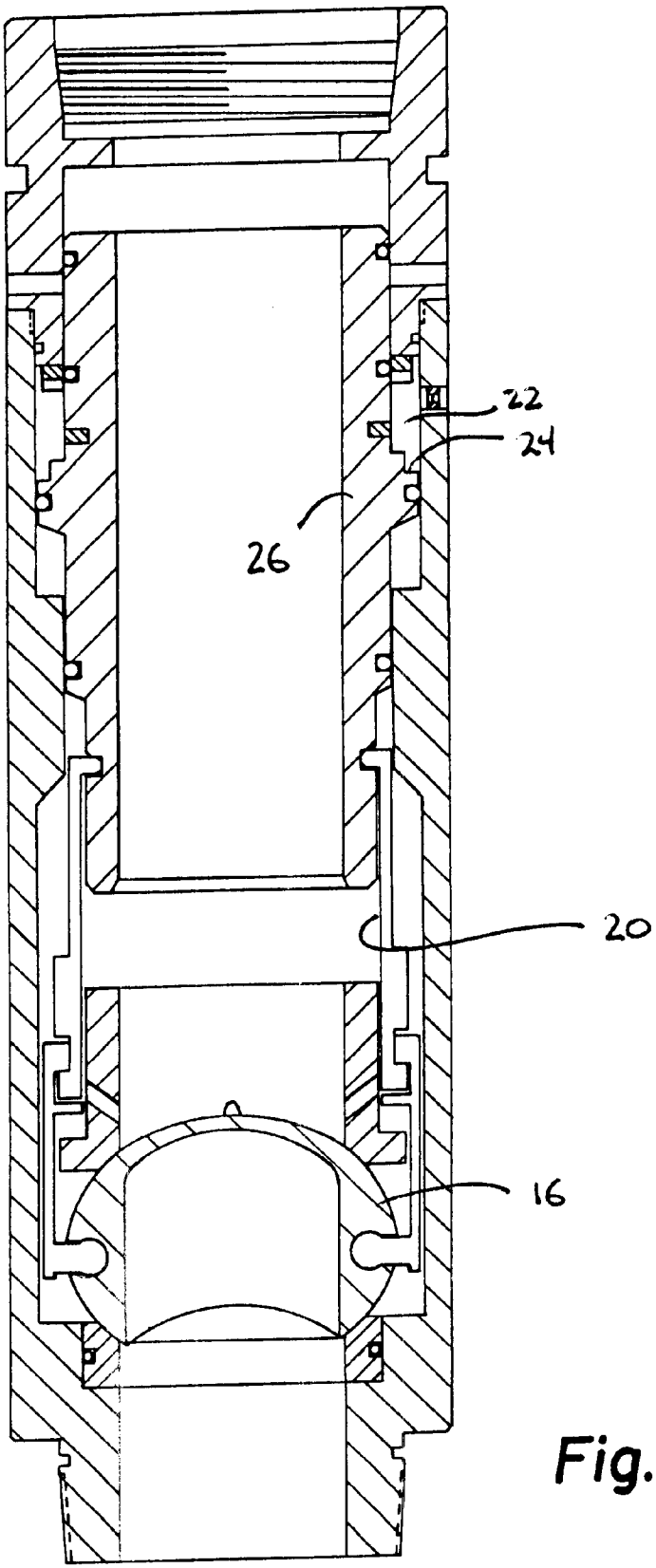
Figure 4:
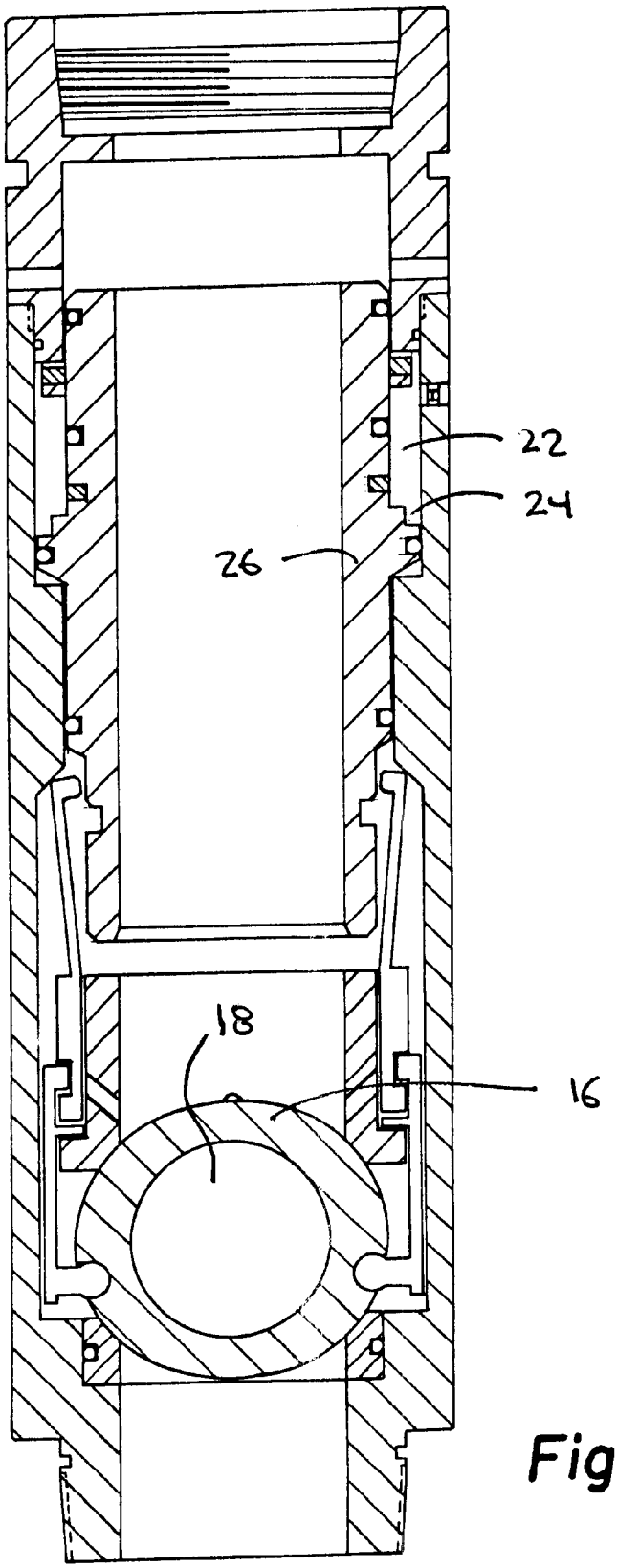
Figure 5:
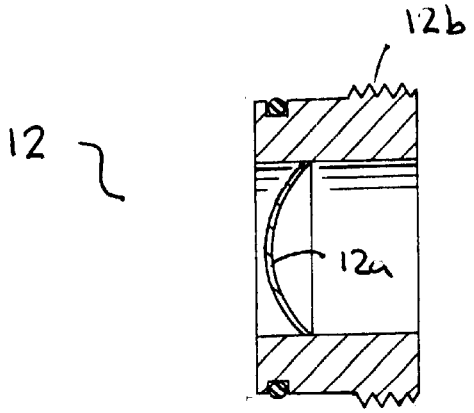
Fig. 5 PRIOR ART
FIG. 5 is a sectional view across the body of a prior art rupture valve.
Figure 6:
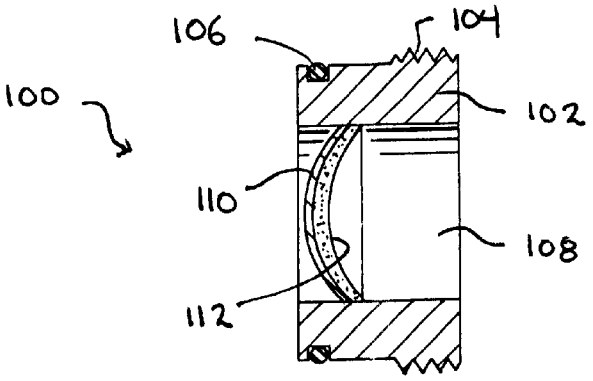
FIG. 6 is a sectional view across the body of a rupture valve embodying the present invention.
Figure 7:
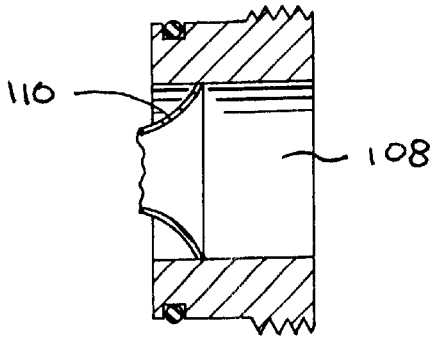
FIG. 7 is a sectional view across the rupture disk of FIG. 6 after a rupture event.

FIGS. 6 and 7 illustrate an improved rupture disk 100 embodying the present invention. The rupture disk 100 includes a generally cylindrical casing 102. The casing can include threading 104 on its outer surface suitable for coupling the rupture disk 100 across a port on a downhole tool. Further, the rupture disk can include a seal 106 such as the o-ring illustrated. The casing 102 defines a central passage 108. The passage can have any suitable diameter, but is typically between ¼ inch and 1 inch. Across the passage is a thin shield, or rupture portion 110. Unlike prior art rupture disk designs, the rupture portion should be of sufficient thickness or burst strength to withstand the annulus pressure.

A destructive, or fusiable, material 112 is placed adjacent to the rupture portion 110. The destructive material 112 can be either an explosive sufficient to blow out the rupture portion 110 or a chemical that would react with and sufficiently weaken or perforate the material of the rupture portion 110. If a chemical reactant is used, it must be temporarily isolated from the rupture portion 110. For example, the chemical reactant might be an acid stored in an inert pouch glued to the rupture portion 110.

Figure 8:
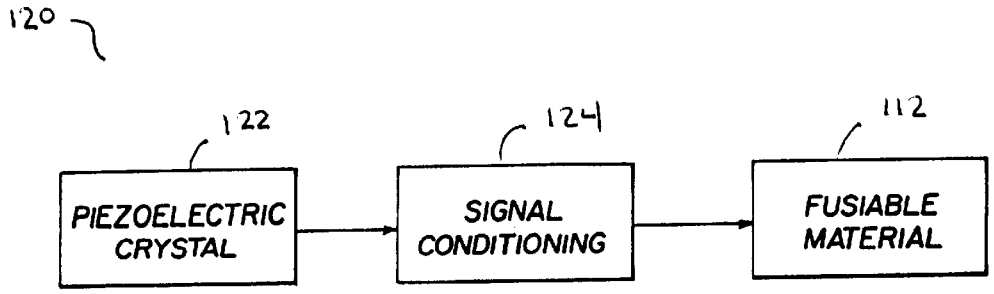
FIGS. 8 and 9 are block diagrams of alternate embodiments of the apparatus used to remotely trigger a rupture event.

To trigger the rupture event, a signal can be transmitted through the fluid column in the well's annulus. Alternatively, the signal can be passed down the pipe or through the adjacent earth. The signal can be an acoustic pressure pulse, an electromagnetic signal, a seismic signal, or a signal from almost any other source. The signal is received by a receiver, or other detection means, which then issues a triggering signal to the destructive material adjacent to the rupture portion. FIG. 8 illustrates an embodiment 120 wherein the receiver is a piezoelectric crystal 122. The crystal has a range of vibrational frequencies that produce an electric output. The output is conditioned 124 to produce a triggering signal. For example, the charge produced by the piezoelectric crystal 122 can be stored on a capacitor until it discharges the charge through a diode and into the destructive material. If the destructive material 112 is an explosive charge, the charge might be sufficient to detonate the explosive. Alternatively, the charge might be used to trigger a detonator that in turn detonates the explosive or ruptures or melts the inert storage sack holding the chemical reactant. This embodiment of the invention has the advantage of being self-contained. No external power source needs to be included, because the piezoelectric crystal translates the vibrational energy from the signal into electricity.

An alternate system embodiment uses several piezoelectric crystals with distinguishable vibrational frequencies. This allows multiple rupture disks to be addressed separately. For example, several downhole tools might be located on a single tool string suspended from the surface. Each device might utilize a rupture disk to achieve actuation. The present invention would allow for each rupture disk to have a specific "address." The address could be the specific signal required before a triggering signal is produced by the microprocessor. Thus, the use of a first signal would trigger only a first rupture disk. A second signal would trigger a second rupture disk. A sequential firing of rupture disks could be achieved, allowing for the sequential operation of several downhole tools.

Figure 9:
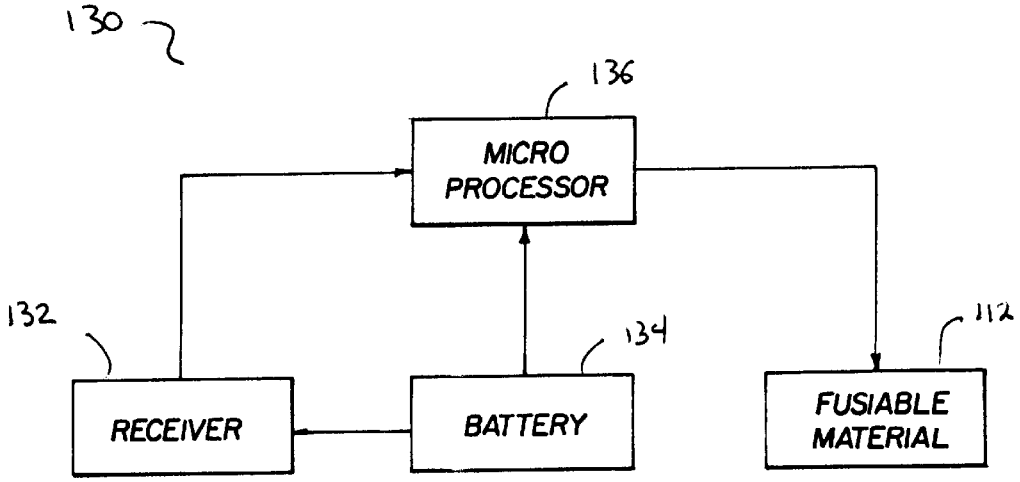

Another alternate system embodiment 130 uses a battery-powered receiver and is illustrated by FIG. 9. The battery 134 is coupled to the receiver 132. The receiver 132 may be capable of receiving multiple signals. For example, the signal might be a timed pulse or a series of several pulses. The signal can be analyzed by a microprocessor 136 which then produces a triggering signal conveyed to the destructive material 112. The added advantage of this alternate system is that multiple ruptured disks could be addressed with distinguishable acoustic signals. For example, several downhole tools might be located on a single tool string suspended from the surface. Each device might utilize a rupture disk to achieve actuation. The present invention would allow for each rupture disk to be programmed with a specific "address." The address could be the specific acoustic signal required before a triggering signal is produced by the microprocessor 136. Thus, the use of a first acoustical signal would trigger only a first rupture disk. The second acoustical signal would trigger a second rupture disk. A sequential filing of rupture disks would be achieved, allowing for the sequential operation of several downhole tools.

The description of the present invention has been presented for purposes of illustration and description, but is not limited to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated. For example, while the term "acoustic" has been used to describe the actuation signal, an electromagnetic signal, seismic signal, or any other suitable signal could also be used. Further, while the description describes the transmission of the signal through the annulus fluid column, it could also be transmitted down the internal fluid column within the tool string or through the metal of the tool string, or through the earth adjacent to the well.

I claim:

1. A method of triggering a rupture event for at least one rupture disk coupled to a downhole tool on a string in a well, the method comprising:

(a) transmitting a signal to a receiver in the well wherein the receiver is coupled to the at least one rupture disk, wherein said signal is acoustic, electromagnetic, or seismic;

(b) triggering the rupture event in response to the signal.

2. The method of claim 1 wherein step (a) comprises transmitting the signal through a fluid column.

3. The method of claim 1 wherein step (a) comprises transmitting the signal through the string.

4. The method of claim 1 wherein step (a) comprises transmitting the signal through the earth adjacent to the well.

5. The method of claim 1 wherein step (a) comprises transmitting an acoustic signal.

6. The method of claim 1 wherein step (a) comprises transmitting an electro-magnetic signal.

7. The method of claim 1 wherein step (a) comprises transmitting a seismic signal.

8. The method of claim 1 wherein step (b) further comprises triggering the rupture event with an output from a piezoelectric crystal.

9. The method of claim 1 wherein step (b) further comprises producing a triggering signal to a first rupture disk in response to a first signal.

10. The method of claim 1 wherein step (b) further comprises exploding a destructive material adjacent to a rupture portion of the rupture disk.

11. The method of claim 1 wherein step (b) further comprises releasing a chemical reactant adjacent to a rupture portion of the rupture disk.

12. The method of claim 1 wherein step (a) comprises transmitting a signal to a non-battery powered receiver.

13. A method of triggering rupture events for rupture disks coupled to downhole tools on a tool string in a well, the method comprising:

transmitting a signal to a plurality of receivers in the well wherein ones of said plurality of receivers are coupled to respective rupture disks;

triggering separate rupture events in response to the signal; wherein ones of said plurality of receivers are individually addressable by said signal.

14. The method of claim 13, wherein said plurality of receivers are piezoelectric crystals having different resonant frequencies.

15. The method of claim 13, wherein said plurality of receivers are coupled to respective microprocessors programmed to recognize different signals.

16. A method of triggering a rupture event, comprising the steps of:

attaching a downhole tool containing a rupture disk to a tool string;

running said downhole tool and said tool string into a well;

transmitting a signal to a receiver in the well wherein the receiver is coupled to the rupture disk;

triggering the rupture event in response to the signal.

17. The method of claim 16, wherein said plurality of receivers are piezoelectric crystals having different resonant frequencies.

18. The method of claim 16, wherein said plurality of receivers are coupled to respective microprocessors programmed to recognize different signals.

19. The method of claim 16, wherein said triggering step explodes a destructive material adjacent a rupture portion of the rupture disk.

20. The method of claim 16, wherein said triggering step releases a chemical reactant adjacent a rupture portion of the rupture disk.

* * * * *